US009736571B2

(12) United States Patent
Gray

(10) Patent No.: US 9,736,571 B2
(45) Date of Patent: Aug. 15, 2017

(54) HEADPHONE SUSPENSION SYSTEM

(71) Applicant: The Quest Group, Irvine, CA (US)

(72) Inventor: Skylar Allen Gray, Irvine, CA (US)

(73) Assignee: The Quest Group, Irvine, CA (US)

( * ) Notice: Subject to any disclaimer, the term of this patent is extended or adjusted under 35 U.S.C. 154(b) by 0 days.

(21) Appl. No.: 14/936,416

(22) Filed: Nov. 9, 2015

(65) Prior Publication Data

US 2016/0134962 A1 May 12, 2016

Related U.S. Application Data

(60) Provisional application No. 62/077,825, filed on Nov. 10, 2014.

(51) Int. Cl.

| | |
|---|---|
| ***H04R 25/00*** | (2006.01) |
| ***H04R 1/10*** | (2006.01) |
| *H04R 5/033* | (2006.01) |

(52) U.S. Cl.

CPC ..... *H04R 1/1066* (2013.01); *H04R 1/1058* (2013.01); *H04R 1/105* (2013.01); *H04R 1/1008* (2013.01); *H04R 5/0335* (2013.01); *H04R 2201/10* (2013.01); *H04R 2201/105* (2013.01)

(58) Field of Classification Search

CPC ..... H04R 1/10; H04R 1/1008; H04R 1/105; H04R 1/1058; H04R 1/1066; H04R 5/033; H04R 5/0335; H04R 2201/10; H04R 2201/105; H04R 2201/107; H04M 1/05

USPC ..... 381/370, 371, 374, 376, 377, 378, 379, 381/383; 379/430

See application file for complete search history.

(56) References Cited

U.S. PATENT DOCUMENTS

| | | | | |
|---|---|---|---|---|
| 3,919,501 A | | 11/1975 | Cech et al. | |
| 4,463,223 A | * | 7/1984 | Yamanoi | H04R 5/0335 2/209 |
| 4,747,145 A | * | 5/1988 | Wiegel | H04M 1/05 381/378 |
| 4,875,233 A | * | 10/1989 | Derhaag | H04M 1/05 379/430 |
| 5,574,795 A | * | 11/1996 | Seki | H04R 5/0335 381/370 |
| 2007/0092098 A1 | * | 4/2007 | Kaderavek | H04R 1/1066 381/370 |
| 2010/0046782 A1 | * | 2/2010 | Ito | H04R 1/105 381/378 |

FOREIGN PATENT DOCUMENTS

| | | |
|---|---|---|
| GB | 2512105 A | 9/2014 |
| WO | WO-2013/099417 A1 | 7/2013 |

* cited by examiner

*Primary Examiner* — Huyen D Le

(74) *Attorney, Agent, or Firm* — McDermott Will & Emery LLP

(57) ABSTRACT

A headphone suspension system includes a headband assembly, a first earcup and a first suspension assembly elastically coupling the first earcup to a first end of the headband assembly. The headphone suspension system further includes a second earcup and a second suspension assembly elastically coupling the second earcup to a second end of the headband assembly.

19 Claims, 3 Drawing Sheets

HEADPHONE SUSPENSION SYSTEM

This application claims the benefit of U.S. Provisional Application No. 62/077,825, titled "HEADPHONE SUSPENSION SYSTEM" and filed on Nov. 10, 2014, which is hereby incorporated by reference herein for all purposes.

BACKGROUND

Headphones position audio drivers near a listener's ears to provide an immersive listening experience and at least partially isolate the listener from ambient noise in the surrounding environment. Over/around-the-ear headphones arrange the audio drivers in earcups that are held in place over/around the listener's ears using a headband. Conventional headphones may connect the headband directly to the earcups using different connection mechanisms. However, this direct connection of rigid bodies (e.g., headband and earcups) may allow vibration from sound or physical interaction with the headphones to propagate from an origination point of the vibration on the headphones to other parts of the headphones, thereby degrading the listening experience of the listener.

SUMMARY

Aspects of the subject technology are directed to a headphone suspension system that includes a headband assembly, a first earcup, and a first suspension assembly elastically coupling the first earcup to a first end of the headband assembly. The headphone suspension system further includes a second earcup, and a second suspension assembly elastically coupling the second earcup to a second end of the headband assembly.

Aspects of the subject technology are further directed to a pair of headphones that include a headband assembly comprising first and second yokes appended to respective ends of a crossmember configured to provide a restorative force to the first and second yokes when the first and second yokes are moved relative to one another. The pair of headphones further includes a first earcup comprising a first audio driver arranged therein, a first suspension assembly elastically suspending the first earcup from the first yoke, a second earcup comprising a second audio driver arranged therein, and a second suspension assembly elastically suspending the second earcup from the second yoke.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the subject technology as claimed.

BRIEF DESCRIPTION OF THE DRAWINGS

The accompanying drawings, which are included to provide further understanding of the subject technology and are incorporated in and constitute a part of this description, illustrate aspects of the subject technology and, together with the specification, serve to explain principles of the subject technology.

DETAILED DESCRIPTION

The detailed description set forth below is intended as a description of various configurations of the subject technology and is not intended to represent the only configurations in which the subject technology may be practiced. The detailed description includes specific details for the purpose of providing a thorough understanding of the subject technology. However, the subject technology may be practiced without these specific details. In some instances, well-known structures and components may not be shown, or may be shown schematically or in block diagram form, to avoid obscuring the concepts of the subject technology.

Headphones may be configured with earcups connected directly to a headband using connection mechanisms such as a hinge or swivel, gimbal, ball-in-socket, friction slide mechanism, or screw/bolt fasteners, for example, forming a direct connection of rigid bodies. When the headband and earcups are in direct contact with one another, any vibration (sound, physical interaction, or otherwise) can propagate from its origination point to any other part in the headband and earcup assembly. For example, sound vibration originating from an audio driver in the left earcup can easily propagate through the earcup, into the headband, and into the right earcup, creating destructive vibration which can interfere with vibrations produced by the audio driver in the right earcup, negatively affecting the audio performance of the headphones. Broadband sound vibration such as music, for example, originating from the audio driver in the left earcup, through direct mechanical coupling to the headband, can cause the headband to vibrate at its natural resonant frequency and alter the frequency response of the headphones in an undesirable manner. Additionally, physical vibration by means of tapping on the headband or brushing against another object can be transmitted and even amplified into the earcups of headphones with a directly coupled headband-earcup structure.

The subject technology is directed to mechanical systems for decoupling headphone earcups from each other and from a headphone's headband by replacing direct mechanical coupling mechanisms with suspension systems. The suspension systems couple the earcups to a headband assembly by suspending the earcups using elastic members. By floating the earcups using the elastic members under tension, for example, the suspension systems provide passive vibration isolation for the earcups from each other and from the headband assembly. In addition, the earcups are floated by the suspension systems in a manner to promote automatic articulation of the earcups to comfortably fit a wide range of head anatomies.

Figure 1:
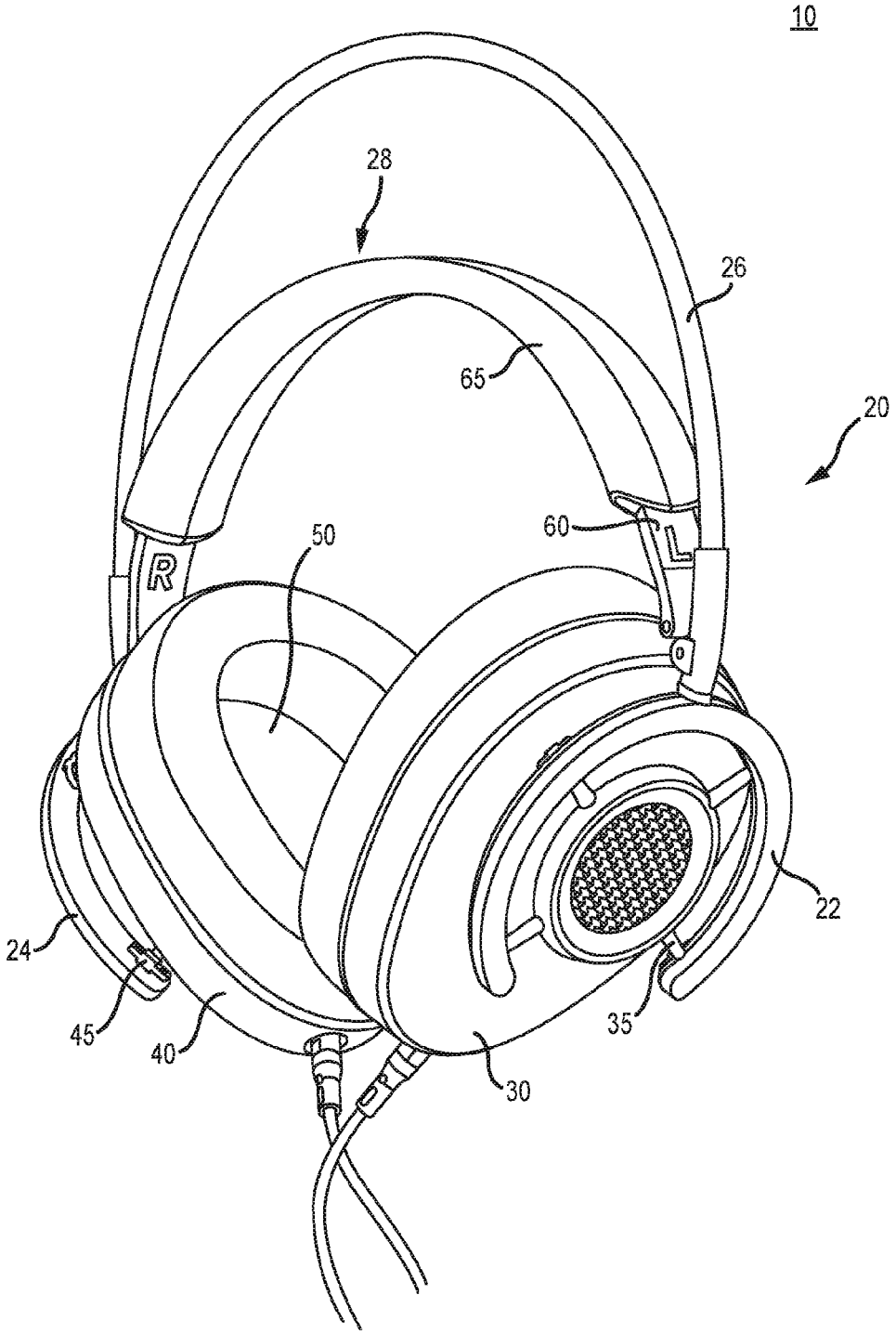
FIG. 1 is a schematic illustration of a headphone comprising a headphone suspension system according to aspects of the subject technology.

FIG. 1 is a schematic illustration of headphones including a headphone suspension system according to aspects of the subject technology. As illustrated in FIG. 1, headphones 10 include a headband assembly 20, which includes a first yoke 22, a second yoke 24, a crossmember 26 and an elastic support band 28. As depicted, headphones 10 further include a first earcup 30 elastically coupled to the first yoke 22 by a first suspension assembly 35 and a second earcup 40 elastically coupled to the second yoke 24 by a second suspension assembly 45. According to aspects of the subject technology, headband assembly 20, first earcup 30, first suspension assembly 35, second earcup 40 and second suspension assembly 45 form components of a headphone suspension system. Headphone suspension systems according to the subject technology are not limited to the specific components and/or arrangements depicted in FIG. 1. For example, headband assembly 20 may not include elastic support band 28 and crossmember 26 may vary from the arrangement depicted in FIG. 1.

First and second earcups 30 and 40 house audio drivers, such audio driver 50. The audio drivers are arranged within the earcups and are configured to be driven by an electrical signal to produce sound for a listener wearing the headphones. The subject technology is not limited to any particular type of audio drivers, or any particular number of audio drivers arranged within each of earcups 30 and 40.

Figure 2:
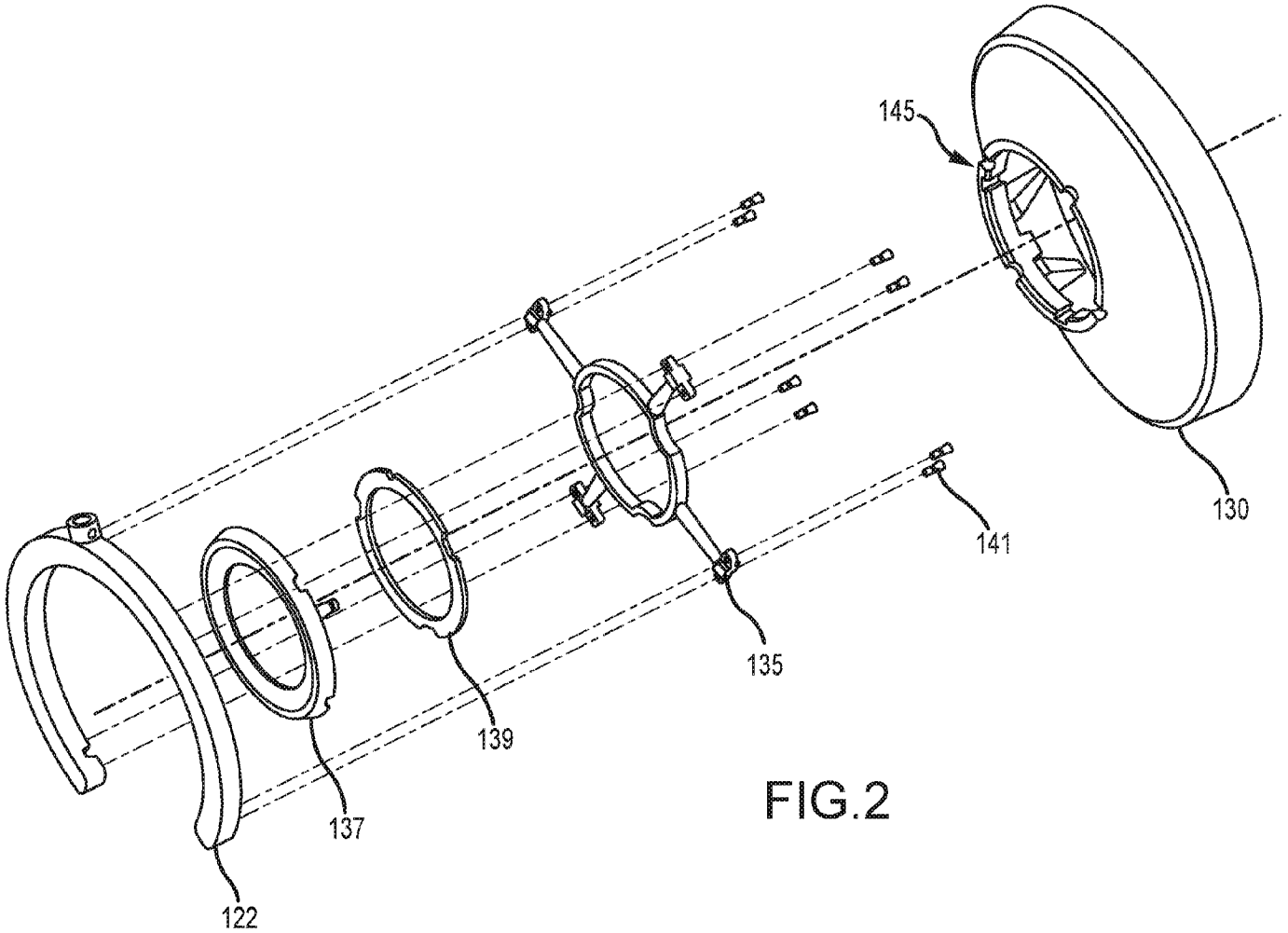
FIG. 2 is disassembled view of components of a headphone suspension system according to aspects of the subject technology.

FIG. 2 is a disassembled view of components of a headphone suspension system according to aspects of the subject technology. The components depicted in FIG. 2 include yoke 122, earcup 130, suspension assembly 135, retention ring 137, isolation gasket 139, and screws 141. Briefly, suspension assembly 135 is used to elastically couple and suspend earcup 130 from yoke 122. Retention ring 137 is used to secure suspension assembly 135 to earcup 130 with isolation gasket 139 arranged between retention ring 137 and suspension assembly 135. The coupling and suspension of earcup 130 with respect to yoke 122 is described in more detail below.

Figure 3:
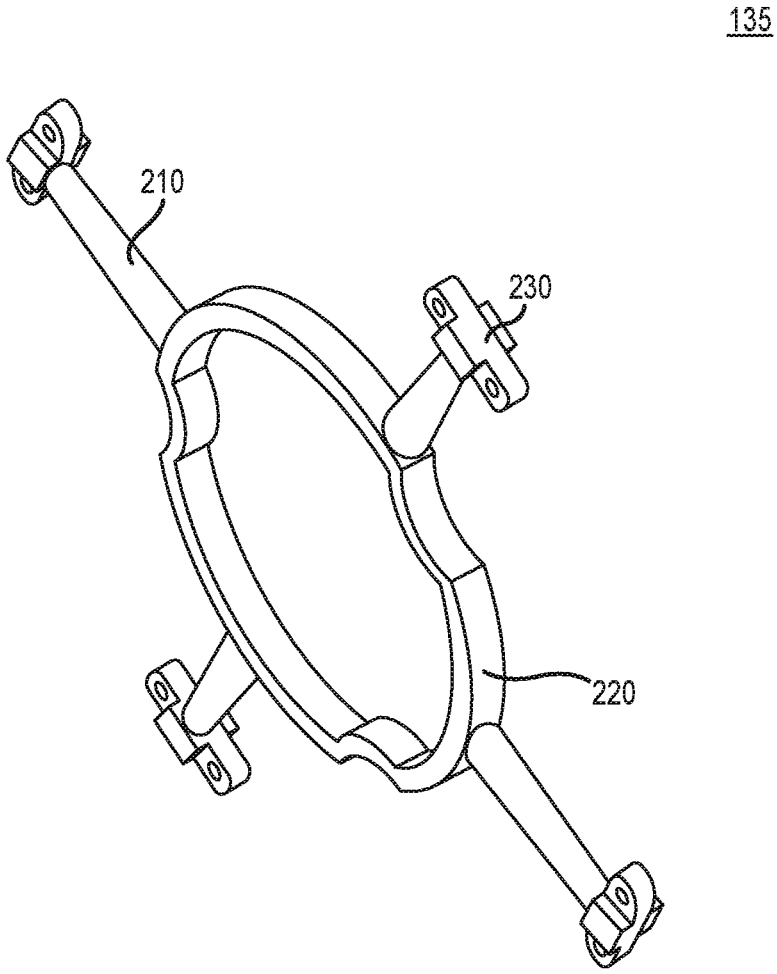
FIG. 3 is a schematic illustration of a suspension assembly according to aspects of the subject technology.

FIG. 3 is a schematic illustration of suspension assembly 135 according to aspects of the subject technology. As depicted in FIG. 3, suspension assembly 135 includes four elastic members 210 radially extending away from suspension band 220. Elastic members 210 are arranged symmetrically around suspension band 220 according to aspects of the technology. In the example shown in FIG. 3, the four elastic members 210 are arranged symmetrically to produce an orthogonal configuration with respect to suspension band 220 and, upon installation, with respect to mount 145 on earcup 130 shown in FIG. 2. The distal ends of elastic members 210 are configured with connector pads 230 to be connected to respective connection points on yoke 122. Connector pads 230 may be connected to the connection points on yoke 122 using screws 141 (shown in FIGS. 1 and 2), adhesives, hooks, pins, snaps, or other types of fasteners and connection means, for example. The subject technology is not limited to the depicted configuration of connector pads 230 arranged on the distal ends of elastic members 210. Other shapes, thicknesses, number of mounting holes, etc. may be employed in implementations of the subject technology.

The subject technology is not limited to four elastic members or to the symmetrical/orthogonal configuration of elastic members 210 with respect to suspension band 220. For example, different numbers of elastic members 210 (e.g., three, five, six, etc.) may extend from suspension band 220. In addition, the arrangement of the elastic members 210 around the suspension band 220 may vary from a symmetrical/orthogonal arrangement to an arrangement with some elastic members being arranged closer together than other elastic members. The arrangement of the elastic members may vary based on the configuration and shape of yoke 122, the configuration and shape of earcup 130, tuning of the headphone suspension system discussed below, product specifications with respect to durability, comfort, adjustability, etc.

Yoke 122 may be made from rigid materials such as aluminum, stainless steel, metal alloys, plastics, etc. to support earcup 130 suspended from yoke 122. The open-ended configuration of yoke 122 shown in FIG. 2 represents one example of a yoke used in the headphone suspension system of the subject technology. The size of the opening in yoke 122 may vary from that shown in FIG. 2. The yoke also may be formed in a closed, circular shape rather than the depicted open-ended shape. In addition, the shape of the yoke may vary from the circular shape shown in FIG. 2. For example, the yoke may have a triangular shape, a square/rectangular shape, an elliptical shape, etc. in various implementations of the subject technology. Varying the configuration of the yoke may result in varying the respective lengths and arrangement of the elastic members of the suspension assembly.

According to aspects of the subject technology, suspension assembly 135 including elastic members 210 and suspension band 220 may be made of an elastomer such as silicone, for example. Other elastic materials may be used in other implementations. Suspension band 220 may be made of a different type of elastomer or other material than that used for elastic members 210. For example, a more rigid material may be used for suspension band 220 to secure suspension assembly 135 to earcup 130, while a more elastic material may be used for elastic members 210 to elastically couple earcup 130 to the connection points on yoke 122. The shape of elastic members 210 depicted in FIGS. 2 and 3 shows a circular or elliptical cross-sectional shape with a gradually tapering cross-sectional area as elastic members 210 extend from suspension band 220 to the connector pads 230 on the distal ends of elastic members 210. The subject technology is not limited to this configuration of elastic members 210. For example, the cross-sectional geometry of elastic members 210 may vary along the length to provide different regions for strength, elasticity, longevity, etc. For example, elastic members 210 may have an elliptical cross-sectional shape where elastic members 210 join suspension band 220 and a circular cross-sectional shape at the distal end of elastic members 210 where connector pads 230 are attached to yoke 122. Other cross-sectional shapes, keeping a single cross-sectional shape and cross-sectional area through the lengths of elastic members 210, etc. are within the scope of the subject technology. In addition, all of elastic members 210 do not need to have the same configuration. For example, elastic members 210 connected to an upper portion of yoke 122, thereby supporting more of the weight of earcup 130, may be larger or have different cross-sectional shapes and areas than other elastic members coupled to a lower portion of yoke 122.

Returning to FIG. 2, retention ring 137 is configured to secure suspension assembly 135 to mount 145 on the back of earcup 130. For example, mount 145 may include an opening or receptacle into which the suspension band 220 of suspension assembly 135 may be placed with elastic members 210 extending out of the opening or receptacle. Retention ring 137 may than be arranged to hold suspension band 220 within the opening or receptacle while allowing elastic members 210 to extend out. Retention ring 137 may rely on a friction fit with respect to the receptacle, a threaded interface, adhesives, or other connection mechanisms to attach to the receptacle with suspension band of suspension assembly 135 arranged there between.

Isolation gasket 139 is an optional element that may be positioned between retention ring 137 and the suspension band of suspension assembly 135. Isolation gasket 139 may be made of any material suitable for suppressing vibration from being communicated between retention ring 137, suspension assembly 135 and earcup 130. In some implementations, retention ring 137 may not use an isolation gasket between the retention ring 137 and the suspension band of suspension assembly 135 and rely on the elastic properties of suspension assembly 135 to help suppress transmission of vibration.

The receptacle depicted in FIG. 2 may be a port behind an audio driver arranged within earcup 130 in a semi-open headphone design. The subject technology is not limited to semi-open headphones. For example, in a closed-back headphone design, a chamber behind the audio driver in the earcup may not open to the receptacle at mount 145 or mount 145 may be a mounting surface rather than a receptacle. In a closed-back headphone design, for example, suspension band 220 may be replaced with another structure, having either a solid or open shape, with which to secure suspension assembly 135 to mount 145 of earcup 130. The suspension band 220 or other structure used to secure suspension assembly 135 to earcup 130 may be referred to generally as a coupling hub. In some implementations, the coupling hub of suspension assembly 135 may be secured to mount 145, or a mounting location on earcup 130, using screws, adhesives, or other connection mechanisms in place of retention ring 137.

The suspension system of the subject technology presented here reduces or eliminates the transmissions of vibrations between earcups 30 and 40 and headband assembly 20 via passive vibration isolation which is, in effect, a mechanical low-pass filter. Vibration energy above the suspension system's resonant frequency cannot be efficiently transmitted and is effectively damped. The suspension system may be tuned to a low resonant frequency (e.g., less than 100 Hz) to improve broadband effectiveness.

Tuning of the suspension system can be achieved by changing the hardness, geometry, and/or tension of the elastic members which suspend the earcups from the headband assembly, and/or by increasing the number of elastic members in the suspension assembly. By physically introducing a high-amplitude impulse into the headphones at various locations, the dominant resonant frequency (or frequencies) of the system can be measured using standard vibration and acoustic measurement hardware and software. The materials and/or configuration used for the suspension assembly can then be changed to vary the elastic members' hardness and/or tension, for instance, and then measure the resonant frequency again to evaluate how the suspension design parameters affect vibration isolation performance. Additional changes to hardness, geometry, and number of elastic members can be iterated as needed to fine-tune the suspension system for optimal performance, being careful to balance acoustic performance with ergonomic/comfort performance.

Because the earcups of the subject technology are elastically coupled to the headband assembly in a suspended and floating arrangement, the earcups are able to articulate three-dimensionally and automatically adapt to unique angles, proportions, and sizes of the listener's head while that listener's head and/or jaw are stationary or moving. This is a unique advantage over typical headphone construction in that the subject technology involves little to no user-interaction or adjustment for fitment, generates little to no friction or wear as the earcups or headband assembly are moved about each other, and generates little to no sound during such movement.

Returning to FIG. 1, the headband assembly 20 includes crossmember 26 and elastic support band 28. Crossmember 26 includes a core structure that may be made from rigid materials such as aluminum, stainless steel, metal alloys, plastics, etc. and is configured to apply a restorative force to first earcup 30 and second earcup 40 when the first and second earcups are spread away from each other to position the headphones on a listener's head. The restorative force presses first and second earcups 30 and 40 against the listener's ears to help isolate the listener from ambient noise in the listener's surroundings. Crossmember 26 is not limited to any particular cross-sectional shape or area and one or both of the cross-sectional shape and area may vary through different regions of crossmember 26. For example, crossmember 26 have a circular cross-sectional shape that maintains a constant cross-sectional area through the length of crossmember 26.

Crossmember 26 may further include one or more isolation sheaths arranged around the core structure to dampen vibrations traveling between yokes 22 and 24 and crossmember 26 as well as through crossmember 26. The isolation sheaths may comprise any known dampening materials and may be arranged around the core structure of crossmember 26 at the point of connection with yokes 22 and 24 and/or along the entire length of the core structure of crossmember 26.

Elastic support band 28 is coupled to yokes 22 and 24 and is configured to support the headphone on the listener's head. Elastic support band 28 may include an inner elastic band 60 made from any elastic material to allow the listener to adjust the position of the earcups with respect to the listener's ears without using rigid mechanical connection devices commonly used in conventional headphones. Inner elastic band 60 may be coupled to yokes 22 and 24 at respective connection points. Inner elastic band 60 may be coupled to the connection points of yokes 22 and 24 using a swiveling pin arrangement, but is not limited to this connection means. Elastic support band 28 optionally may include a cushioned sleeve 65 with elastic support band 28 slideably arranged within. With this configuration, inner elastic band 60 is able to move relative to cushioned sleeve 65 while the headphones are placed on a listener's head. In this manner, elastic support band provides comfort or protection purposes while the listener is wearing the headphones. As noted above, elastic support band 28 is an optional element of headband assembly 20 in some implementations. For example, the shape of earcups 30 and 40 combined with the restorative force applied by crossmember 26 may be used to support the headphones on the listener's head.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

A phrase such as "an aspect" does not imply that such aspect is essential to the subject technology or that such aspect applies to all configurations of the subject technology. A disclosure relating to an aspect may apply to all configurations, or one or more configurations. An aspect may provide one or more examples of the disclosure. A phrase such as "an aspect" may refer to one or more aspects and vice versa. A phrase such as "an embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples of the disclosure. A phrase such "an embodiment" may refer to one or more embodiments and vice versa. A phrase such as "a configuration" does not imply that such configuration is essential to the subject technology or that such configuration applies to all configurations of the subject technology. A disclosure relating to a configuration may apply to all configurations, or one or more configurations. A configuration may provide one or more examples of the disclosure. A phrase such as "a configuration" may refer to one or more configurations and vice versa.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

Furthermore, to the extent that the term "include," "have," or the like is used herein, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While certain aspects and embodiments of the subject technology have been described, these have been presented by way of example only, and are not intended to limit the scope of the subject technology. Indeed, the novel methods and systems described herein may be embodied in a variety of other forms without departing from the spirit thereof. The embodiments presented above and their equivalents are intended to cover such forms or modifications as would fall within the scope and spirit of the subject technology.

What is claimed is:

1. A headphone suspension system, comprising:

a headband assembly comprising a first yoke arranged on a first end of the headband assembly and a second yoke arranged on a second end of the headband assembly;

a first earcup having a first mount;

a first suspension assembly comprising a first suspension band and a first plurality of elastic members extending from the first suspension band, wherein the first suspension assembly is arranged within an opening of the first yoke with the first plurality of elastic members elastically coupling the first mount of the first earcup to respective connection points on the first yoke;

a first retention ring configured to secure the first suspension band to the first mount of the first earcup;

a second earcup having a second mount;

a second suspension assembly comprising a second suspension band and a second plurality of elastic members extending from the second suspension band, wherein the second suspension assembly is arranged in an opening of the second yoke with the second plurality of elastic members elastically coupling the second mount of the second earcup to respective connection points on the second yoke; and a second retention ring configured to secure the second suspension band to the second mount of the second earcup.

2. The headphone suspension system of claim 1, wherein each of the first and second pluralities of elastic members comprises four elastic members.

3. The headphone suspension system of claim 1, wherein the first plurality of elastic members is arranged in an orthogonal configuration with respect to the first mount on the first earcup, and wherein the second plurality of elastic members is arranged in an orthogonal configuration with respect to the second mount on the second earcup.

4. The headphone suspension system of claim 1, further comprising:

a first isolation gasket arranged between the first retention ring and the first suspension band; and a second isolation gasket arranged between the second retention ring and the second suspension band.

5. The headphone suspension system of claim 1, wherein the headband assembly comprises:

a crossmember connecting the first yoke to the second yoke and configured to apply a restorative force to the first and second yokes to hold the first and second earcups against a listener's ears.

6. The headphone suspension system of claim 5, wherein the crossmember comprises:

a core structure; and an isolation sheath surrounding the core structure configured to isolate vibration passing between the first and second yokes and the core structure.

7. The headphone suspension system of claim 6, wherein headband assembly further comprises an elastic support band coupled to the first yoke and to the second yoke and configured to support the headphone suspension system on the listener's head.

8. The headphone suspension system of claim 7, wherein the elastic support band comprises:

a cushioned sleeve; and an inner elastic band slideably arranged within the cushioned sleeve, wherein a first end of the inner elastic band extends from the cushioned sleeve and is coupled to a base of the first yoke, and a second end of the inner elastic band extends from the cushioned sleeve and is coupled to a base of the second yoke.

9. A headphone, comprising:

a headband assembly comprising first and second yokes appended to respective ends of a crossmember configured to provide a restorative force to the first and second yokes when the first and second yokes are moved relative to one another;

a first earcup comprising a first audio driver arranged therein;

a first suspension assembly elastically suspending the first earcup from the first yoke, the first suspension assembly comprising:

a first coupling hub; and a first plurality of elastic members arranged symmetrically around and extending radially away from the first coupling hub, wherein the first coupling hub is secured to a first mount of the first earcup and the first plurality of elastic members are secured to respective connection points on the first yoke;

a first retention ring configured to secure the first coupling hub to the first mount of the first earcup;

a second earcup comprising a second audio driver arranged therein; and a second suspension assembly elastically suspending the second earcup from the second yoke, the second suspension assembly comprising:

a second coupling hub; and a second plurality of elastic members arranged symmetrically around and extending radially away from the second coupling hub, wherein the second coupling hub is secured to a second mount of the second earcup and the second plurality of elastic members are secured to respective connection points on the second yoke; and a second retention ring configured to secure the second coupling hub to the second mount of the second earcup.

10. The headphone of claim 9, wherein the first and second suspension assemblies comprise an elastomer.

11. The headphone of claim 10, further comprising:

a first gasket arranged between the first retention ring and the first coupling hub; and a second gasket arranged between the second retention ring and the second coupling hub.

12. The headphone of claim 11, wherein the headband assembly further comprises:

a cushioned sleeve; and an elastic band slideably arranged within the cushioned sleeve, wherein a first end of the elastic band extends from the cushioned sleeve and is coupled to a base of the first yoke, and a second end of the elastic band extends from the cushioned sleeve and is coupled to a base of the second yoke.

13. The headphone of claim 12, wherein the crossmember comprises:

a core structure; and an isolation sheath surrounding at least a portion of the core structure and arranged at least partially between the first and second yokes and the core structure.

14. A headphone suspension system, comprising:

a headband assembly comprising:

a crossmember comprising a core structure and an isolation sheath surrounding the core structure;

a first yoke appended to a first end of the crossmember;

a second yoke appended to a second end of the crossmember; and an elastic support band comprising a cushioned sleeve and an inner elastic band slideably arranged within the cushioned sleeve, wherein a first end of the inner elastic bend extends from the cushioned sleeve and is coupled to a base of the first yoke, and a second end of the inner elastic band extends from the cushioned sleeve and is coupled to a base of the second yoke, wherein the crossmember is configured to apply a restorative force to the first and second yokes when the first and second yokes are moved relative to one another;

a first earcup;

a first suspension assembly elastically coupling the first earcup to the first yoke;

a second earcup; and a second suspension assembly elastically coupling the second earcup to the second yoke.

15. The headphone suspension system of claim 14, wherein the first suspension assembly comprises a first plurality of elastic members elastically coupling a first mount on the first earcup to respective connection points on the first yoke, and wherein the second suspension assembly comprises a second plurality of elastic members elastically coupling a second mount on the second earcup to respective connection points on the second yoke.

16. The headphone suspension system of claim 15, wherein the first suspension assembly further comprises a first suspension band from which the plurality of elastic members radially extend, and wherein the second suspension assembly further comprises a second suspension band from which the plurality of elastic members radially extend.

17. The headphone suspension system of claim 16, wherein the first plurality of elastic members are arranged in an orthogonal configuration with respect to the first mount on the first earcup, and wherein the second plurality of elastic members are arranged in an orthogonal configuration with respect to the second mount on the second earcup.

18. The headphone suspension system of claim 16, further comprising:

a first retention ring configured to secure the first suspension band to the first mount on the first earcup; and a second retention ring configured to secure the second suspension band to the second mount on the second earcup.

19. The headphone suspension system of claim 18, further comprising:

a first isolation gasket arranged between the first retention ring and the first suspension band; and a second isolation gasket arranged between the second retention ring the second suspension band.

* * * * *